United States Patent [19]

Macrorie et al.

[11] 4,311,208

[45] Jan. 19, 1982

[54] LADDER SAFETY LAMP

[76] Inventors: Patrick L. Macrorie, 508 N. Ward St., La Habra, Calif. 90631; Ronald C. Rohrenbacher, 824 Tamar Dr., La Puente, Calif. 91746; Stephen B. Austin, 11462 Havenwood Dr., Whittier, Calif. 90606

[21] Appl. No.: 170,032

[22] Filed: Jul. 18, 1980

[51] Int. Cl.[3] ..... E06C 5/44; E06C 5/34

[52] U.S. Cl. ..... 182/18; 182/39; 182/129

[58] Field of Search ..... 182/129, 194, 93, 39, 182/18; 52/182

[56] References Cited

U.S. PATENT DOCUMENTS

| | | | |
|---|---|---|---|
| 145,209 | 12/1873 | Hyatt | 52/182 |
| 903,730 | 11/1908 | Kohn et al. | 52/182 |
| 2,479,500 | 8/1949 | Longberg | 52/182 |
| 2,691,718 | 10/1954 | Bowers | 52/182 |

*Primary Examiner*—Reinaldo P. Machado

*Attorney, Agent, or Firm*—Edgar W. Averill, Jr.

[57] ABSTRACT

A warning light assembly for use on ladders having a plurality of rungs to indicate the presence of someone on the ladder. The warning light assembly has a switch activated by a person's foot placed on one of the lower rungs of the ladder. When first activated, the switch turns on a flashing light positioned about eye level. As the person disembarks from the ladder, his foot on the lower rung again activates the switch turning off the flashing light.

8 Claims, 5 Drawing Figures

LADDER SAFETY LAMP

BACKGROUND OF THE DISCLOSURE

Numerous accidents are caused each year by someone moving a ladder which is in use. This is particularly true in industrial applications where service work must be performed by someone standing on a ladder and the day in and day out presence of the ladder and its frequent use gives rise to a certain amount of carelessness and numerous injuries result.

Another problem is in descending the ladder, once again as a result of familiarity, the user will often believe that he is stepping on the last rung of the ladder whereas he is in fact stepping on the second to last or third to last rung. He then steps off that rung expecting to step on the floor and instead the floor is not where he expects, and the result is often a sprained ankle or other injury.

In many applications such as telephone company switching rooms, the user places a sign on the ladder when he is working from the ladder but unfortunately occasionally the sign is not noticed and further occasionally the sign is not used.

There is thus a need for an automatic system which does not require the user to take any overt act and which is more noticeable than a sign. Also, there is a need to provide a positive signal when the user steps on the lowermost rung of the ladder to prevent the possible injury described above.

SUMMARY OF THE INVENTION

It is thus an object of the present invention to provide a ladder safety light which signals the presence of someone on a ladder.

It is a further object of the present invention to provide a signal device which tells the user of the ladder when he is stepping on the lowermost rung of the ladder.

The present invention is for a warning light assembly for use on ladders. The warning light assembly has switch means activated by a person's foot placed on one of the lower rungs of the ladder. The switch means activates signal means also attached to the ladder. The signal means are then turned off by the user's foot being placed on the ladder a second time. Preferably, the switch means is located on the lowermost rung of the ladder, and the signal means is a flashing light. Still further preferably, the signal means is a light source and photocell which is interrupted by the user's foot.

DESCRIPTION OF THE PREFERRED EMBODIMENTS

Figure 1:
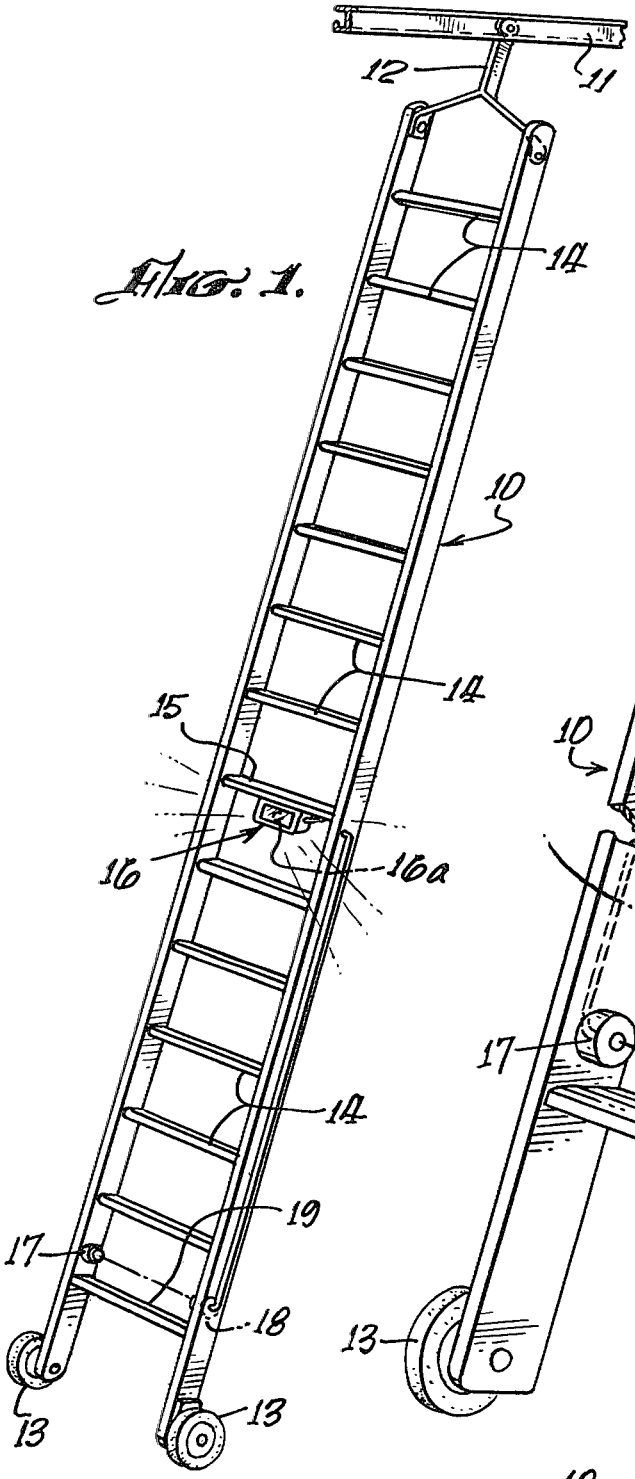
FIG. 1 is a perspective view of a ladder having the warning light and switch of the present invention affixed thereto.
Figure 5:
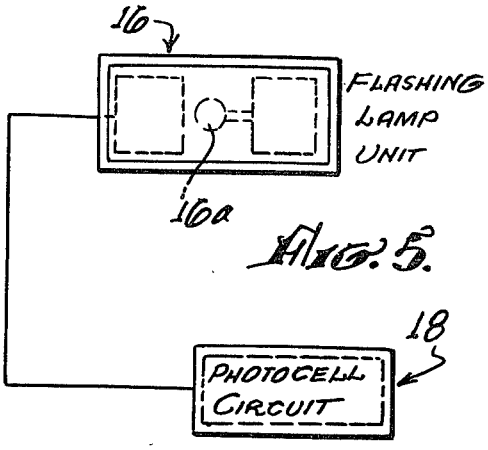
FIG. 5 is a schematic block diagram of the switch and signaling units of the present invention.

A ladder 10 is held at its upper end to a rail 11 by a sliding arm 12. The ladder has a pair of wheels 13 at the lower end and can be rolled below rail 11 to a desired working position. Such ladders are frequently used in telephone switching rooms and other locations where it is necessary to perform work at various locations above normal reaching levels. Such ladders are typically equipped with soldering irons and other electrical apparatuses to facilitate the work.

Ladder 10 has a plurality of rungs or steps 14. Tool kits and other apparatuses are commonly hung from such rungs or steps.

Figure 2:
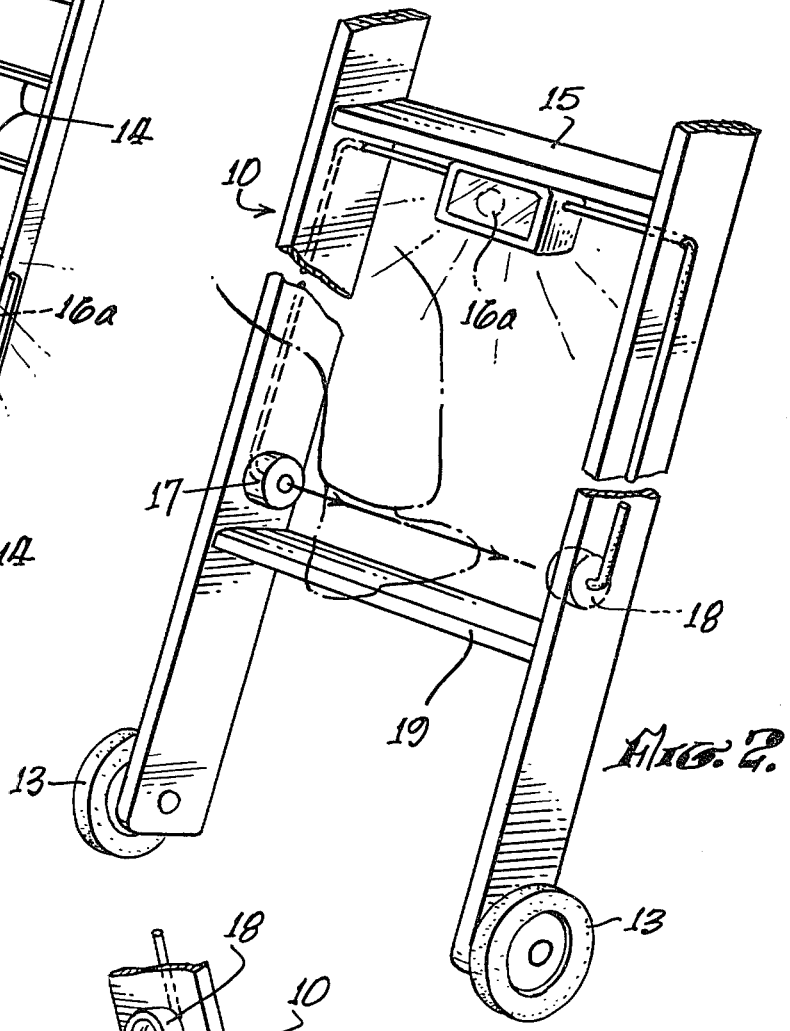
FIG. 2 is an enlarged fragmentary view of the switch means and signal means of the ladder of FIG. 1.
Figure 3:
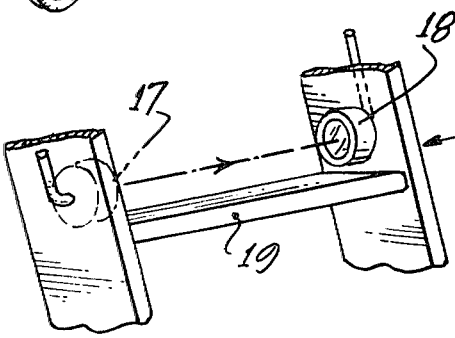
FIG. 3 is an enlarged perspective view of the switch means of the ladder of FIG. 1.

As shown in FIG. 2, a signal means comprising a flashing light is located on the rung indicated by reference character 15 and the flasher unit is indicated generally by reference character 16 (the bulb being shown at 16*a*). Switch means comprising a light source 17 and a photocell 18 is positioned above lowermost rung 19. The switch means need not be on the lowermost rung but such positioning is preferred for the reduction of possible accidents occuring from user's stepping off the ladder before they have reached the bottom step. Flasher unit 16 is preferably located at approximately eye level to increase visibility.

The unit of the present invention has the advantage of being completely passive, that is, it does not require the user to consciously turn on any switch but instead merely stepping on the rung 19 initiates the flasher unit 16. Similarly upon his descent from the ladder, his stepping again on rung 19 turns off the flasher unit.

Figure 4:
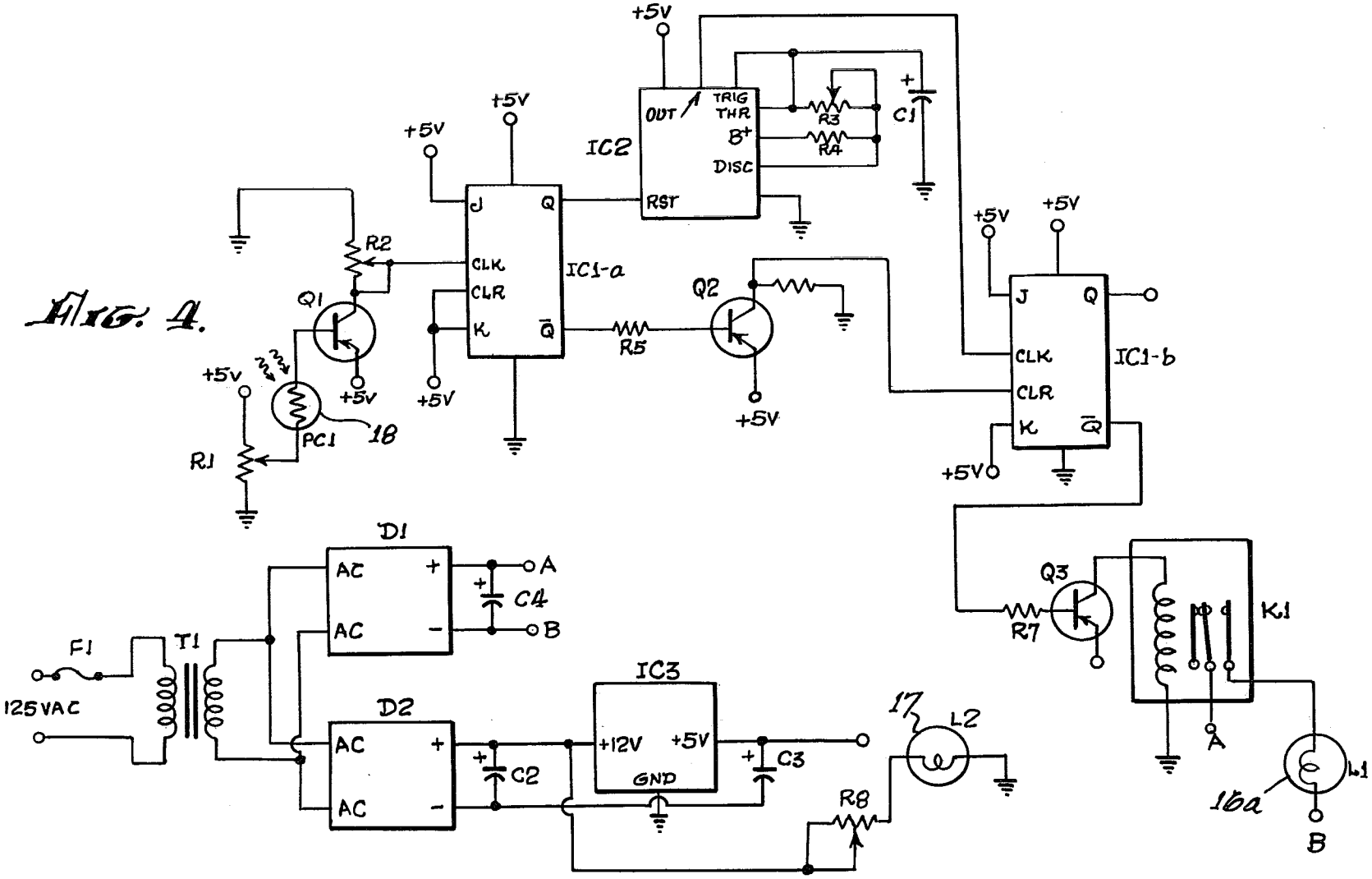
FIG. 4 is a schematic of a preferred switch circuit of the present invention.

A preferred circuit diagram to accomplish the above-described result is shown in the schematic of FIG. 4. A 125 volt AC power source is connected through a 3 amp slow blow fuse F1 to the primary coils of transformer T1. The secondary coils produce 12 volt AC, 3 amp current which is connected to 2 amp diode bridges D1 and D2 which provides a 12 volt DC source across capacitor C4 at the terminals A and B. Capacitor C4 is 1000 microfarad, volt DC filter capacitor. Similarly, diode bridge D2 supplies 12 volt DC across capacitor C2. Capacitor C2 is a 1000 microfarad 25 volt DC capacitor which likewise functions as a filter. Regulator 27 labeled IC3 is a 7805 +5 volt, 750 milli amp regulator grounded as shown and providing a 5 volt output across capacitor C3. C3 is a 10 microfarad 12 volt DC tantalum filter capacitor. 12 volts is supplied to 100 ohm potentiometer R8 which regulates the intensity of a number 47 pilot lamp L2 which supplies the light source for the photocell PC1.

Photocell PC1 is a Sylvania EGG 200 photocell which is supplied through 10K ohm potentiometer R2 which sets the bias level between the photocell PC1 and transistor Q1. The output of transformer Q1 (2N508A) is passed through a 1 K ohm potentiometer (R2) which is connected to IC1 which is a 7473 dual JK level triggered flip flop (with preclear). The "Q" lead of IC1-a is connected to the "RST lead" of 555 timer IC2 as shown. The "$\overline{Q}$" lead is connected through a 1 K ohm ¼ watt resistor R5 to transistor Q2 which is a 2N508A. R6 is a 470 ohm ¼ watt resistor and Q2 is connected to the CLR terminal of IC1B which like IC1A is a 7473 dual JK level triggered flip flop (with preclear). The "THR" terminal of timer IC2 is connected to 20 K ohm potentiometer R3 and the "TRIG" terminal of timer IC2 is connected to a 10 microfarad, 10 volt DC elect. capacitor. The "3+" terminal is connected to 10 K ohm ¼ watt resistor R4.

The output of timer IC2 is connected to the "CLK" terminal of IC1B whose "$\overline{Q}$" terminal is connected through resistor R7 (1 K ohm ¼ watt) to transistor Q3

(QN568A) which in turn is connected to K1 as shown which is a 5 volt 60 milli amp SPDT relay which in turn is connected to a 12 volt high intensity lamp L1.

In operation as an individual proceeds up the ladder, his foot breaks the light beam supplied by pilot lamp L2 (reference character 17) aimed at photocell PC1 (reference character 18). Resistor R1 sets the bias level between photocell PC1 and transistor Q1. As Q1 changes state, the voltage drop across resistor R2 decreases changing the "CLK" lead of "IC1-a" from a high level to a low level momentarily. "ICI-a" then changes its output state-"Q" lead from a low level to a high level and the "$\overline{Q}$" lead from a high level to a low level. Timer "IC2" begins to oscillate via the low level being lifted from its "RST" lead. Timer "IC2" charges via resistors R3, R4 and capacitor "C1" and discharge through capacitor "C1" and resistor "R3". As "IC2" oscillates, it triggers the "CLK" lead of "IC1-b". The "Q" lead of "IC1-b" changes at half the rate at which "IC2" oscillates. "IC1-b" drives "Q3" which operates and releases relay "K1" at a steady rate. The 12 volt high intensity lamp "L1" will flash a warning as the contacts of relay "K1" open and close.

The flashing continues until the user descends from the ladder stepping on the lowermost rung and breaking the light beam a second time. This changes the state of "IC1-a". The "Q" lead of "IC1-a" switches to a low level turning off "IC2" via its "RST" lead. The "$\overline{Q}$" lead of "IC1-a" goes to a high level changing the bias of "Q2". "Q2" drives the "CLR" lead of "IC1-b" low holding its "$\overline{Q}$" lead high to insure that "K1" does not remain operated.

Transformer "T1" converts the 125 volt AC source to 12 volt AC and "F1" is used for overload protection. "D1" changes 12 volt AC to 12 volt DC to supply "L1". "D2" also converts 12 volt AC to 12 volt DC which is dropped and regulated to 5 volt DC by "IC3". Capacitors C2, C3 and C4 are used as filters. Potentiometer R8 controls the intensity of light "L2" which is the light source for photocell "PC1".

While the present invention preferably utilizes a photocell light source as the switching means, other switching means could alternatively be used. Likewise, while the signal means is shown as a flashing light, it is possible, although not preferred, that an audible sound be used in place of the light or both a sound and light could be used.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A warning signal assembly for use on ladders having a plurality of rungs to indicate the presence of someone on the ladder, said warning signal assembly comprising:

switch means activated by a person's foot placed on one of the lower rungs, said switch means activating signal means, said signal means being deactivated by a person's foot placed on one of said lower rungs.

2. The assembly of claim 1 wherein said switch means is positioned above the lowermost rung.

3. The assembly of claim 1 wherein said signal means comprises light means.

4. The assembly of claim 3 wherein said signal means is a flashing light.

5. The assembly of claim 1 wherein said switch means is activated by the interruption of a light beam.

6. The assembly of claim 1 wherein said signal means is a light source and photocell positioned above the lowermost rung.

7. The assembly of claim 6 wherein said signal means is a flashing light.

8. The assembly of claim 7 wherein said flashing light is positioned at about eye level below one of said rungs.

* * * * *